US008132339B2

(12) United States Patent
Moon et al.

(10) Patent No.: US 8,132,339 B2
(45) **Date of Patent: *Mar. 13, 2012**

(54) CLOTH TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 877 days.

This patent is subject to a terminal disclaimer.

(21) Appl. No.: 12/219,946

(22) Filed: Jul. 30, 2008

(65) Prior Publication Data

US 2009/0151193 A1 Jun. 18, 2009

(30) Foreign Application Priority Data

Aug. 3, 2007 (KR) ..... 10-2007-0078172

(51) Int. Cl.
*F26B 11/03* (2006.01)

(52) U.S. Cl. ..... 34/601; 34/603; 34/610; 68/5 C; 68/6; 8/137; 8/158

(58) Field of Classification Search ..... 34/595, 34/601, 602, 603, 610, 210, 218; 68/5 C, 68/6, 158; 137/312; 8/137, 158
See application file for complete search history.

(56) References Cited

U.S. PATENT DOCUMENTS

| | | | | | |
|---|---|---|---|---|---|
| 2,114,776 | A | * | 4/1938 | Davis | 68/18 R |
| 2,644,245 | A | * | 7/1953 | Hammell et al. | 34/547 |
| 2,654,160 | A | * | 10/1953 | Peterson | 34/543 |
| 2,657,475 | A | * | 11/1953 | Erickson | 34/139 |
| 2,675,628 | A | * | 4/1954 | O'Neil | 34/75 |
| 2,686,372 | A | * | 8/1954 | Graham | 34/75 |
| 2,701,421 | A | * | 2/1955 | Erickson et al. | 34/530 |
| 2,706,346 | A | * | 4/1955 | Smith | 34/75 |
| 2,717,456 | A | * | 9/1955 | Smith | 34/75 |
| 2,722,057 | A | * | 11/1955 | Pugh | 34/74 |
| 2,724,905 | A | * | 11/1955 | Zehrbach | 34/75 |
| 2,724,906 | A | * | 11/1955 | Pfleider | 34/75 |
| 2,785,557 | A | * | 3/1957 | Stilwell, Jr. | 68/12.15 |

(Continued)

FOREIGN PATENT DOCUMENTS

CA 2 357 768 A1 3/2003

(Continued)

*Primary Examiner* — Stephen M. Gravini
(74) *Attorney, Agent, or Firm* — McKenna Long & Aldridge LLP

(57) ABSTRACT

Disclosed is a cloth treating apparatus, which supplies hot air to a accommodating space receiving clothes to dry the clothes. The cloth treating apparatus includes a cabinet including a accommodating space to receive clothes, and an electric component chamber, in which a moisture supply device to spray steam to the accommodating space and a air supply device to supply hot air are installed; and a condensed water treating unit to treat condensed water, generated by condensing the steam sprayed to the accommodating space or the hot air supplied from the air supply device. Therefore, the cloth treating apparatus treats the condensed water generated in the accommodating space, and thus prevents the generation of substances harmful to the human body, such as mold, in the accommodating space.

10 Claims, 5 Drawing Sheets

U.S. PATENT DOCUMENTS

| | | | | | |
|---|---|---|---|---|---|
| 2,807,890 | A | * | 10/1957 | Stone | 34/549 |
| 2,833,056 | A | * | 5/1958 | Smith | 34/527 |
| 2,834,121 | A | * | 5/1958 | Geldhof | 34/75 |
| 2,838,845 | A | * | 6/1958 | Erickson | 34/547 |
| 2,853,798 | A | * | 9/1958 | Morrison | 34/75 |
| 2,856,699 | A | * | 10/1958 | Frey | 34/75 |
| 2,864,175 | A | * | 12/1958 | Stone | 34/75 |
| 2,869,346 | A | * | 1/1959 | Brucken | 68/19.2 |
| 2,878,662 | A | * | 3/1959 | Brucken | 68/19.2 |
| 2,885,789 | A | * | 5/1959 | Conkling et al. | 34/547 |
| 2,892,335 | A | * | 6/1959 | Gray, Jr. | 68/16 |
| 2,893,135 | A | * | 7/1959 | Smith | 34/610 |
| 2,911,731 | A | * | 11/1959 | Bochan | 34/75 |
| 2,911,810 | A | * | 11/1959 | Lantz et al. | 68/12.15 |
| 2,919,493 | A | * | 1/1960 | Candor | 34/549 |
| 2,921,384 | A | * | 1/1960 | Smith | 34/75 |
| 2,925,663 | A | * | 2/1960 | Smith | 34/75 |
| 2,928,267 | A | * | 3/1960 | Frey et al. | 68/12.22 |
| 2,958,954 | A | * | 11/1960 | Longenecker | 34/527 |
| 2,985,966 | A | * | 5/1961 | Martin | 34/75 |
| 2,986,917 | A | * | 6/1961 | Smith | 68/20 |
| 2,996,809 | A | * | 8/1961 | Shapter | 34/75 |
| 3,012,333 | A | * | 12/1961 | Leonard | 34/75 |
| 3,022,581 | A | * | 2/1962 | Smith | 34/75 |
| 3,029,525 | A | * | 4/1962 | Pinder | 34/75 |
| 3,040,440 | A | * | 6/1962 | Mellinger et al. | 34/75 |
| 3,050,974 | A | * | 8/1962 | Smith | 68/20 |
| 3,050,975 | A | * | 8/1962 | Pinder | 68/20 |
| 3,091,955 | A | * | 6/1963 | Taylor et al. | 68/19.2 |
| 3,102,796 | A | * | 9/1963 | Erickson | 34/75 |
| 3,121,000 | A | * | 2/1964 | Hubbard | 34/75 |
| 3,132,005 | A | * | 5/1964 | McMillan | 34/569 |
| 3,186,104 | A | * | 6/1965 | Stilwell, Jr. | 34/527 |
| 3,231,909 | A | * | 2/1966 | Candor | 8/159 |
| 3,301,024 | A | * | 1/1967 | Smith | 68/12.15 |
| 3,321,843 | A | * | 5/1967 | Taran | 34/596 |
| 3,346,115 | A | * | 10/1967 | Mellinger | 34/319 |
| 3,358,302 | A | * | 12/1967 | Candor | 8/159 |
| 3,546,783 | A | * | 12/1970 | Candor et al. | 34/250 |
| 3,648,381 | A | * | 3/1972 | Fox | 34/82 |
| 3,732,628 | A | * | 5/1973 | Blevens et al. | 34/389 |
| 3,802,918 | A | * | 4/1974 | Landwier | 134/105 |
| 3,831,292 | A | * | 8/1974 | DePas | 34/75 |
| 3,858,330 | A | * | 1/1975 | De Pas | 34/75 |
| 3,859,004 | A | * | 1/1975 | Condit | 34/75 |
| 3,866,333 | A | * | 2/1975 | Sarukahanian et al. | 34/75 |
| 3,875,268 | A | * | 4/1975 | DePass | 261/88 |
| 3,875,679 | A | * | 4/1975 | Condit | 34/75 |
| 3,875,681 | A | * | 4/1975 | De Pas | 34/75 |
| 3,940,861 | A | * | 3/1976 | Frazar | 34/75 |
| 5,152,077 | A | | 10/1992 | Liang | |
| 5,207,764 | A | * | 5/1993 | Akabane et al. | 68/20 |
| 5,606,878 | A | * | 3/1997 | Arreghini et al. | 68/17 R |
| 6,279,357 | B1 | * | 8/2001 | Didlick et al. | 68/20 |
| 6,557,266 | B2 | * | 5/2003 | Griffin | 34/168 |
| 6,840,068 | B2 | * | 1/2005 | Pasin et al. | 68/5 C |
| 6,868,621 | B1 | * | 3/2005 | Grimm et al. | 34/92 |
| 6,966,124 | B2 | * | 11/2005 | Ryu | 34/134 |
| 6,966,203 | B2 | * | 11/2005 | Matsuda et al. | 68/12.15 |
| 7,017,282 | B2 | * | 3/2006 | Pyo et al. | 34/596 |
| 7,020,983 | B2 | * | 4/2006 | Bolduan et al. | 34/506 |
| 7,055,262 | B2 | * | 6/2006 | Goldberg et al. | 34/86 |
| 7,062,863 | B2 | * | 6/2006 | Chung | 34/596 |
| 7,235,109 | B2 | * | 6/2007 | Kleker | 8/149.3 |
| 7,347,005 | B2 | * | 3/2008 | Cerruti | 34/235 |
| 7,481,005 | B2 | * | 1/2009 | Bolduan et al. | 34/95 |
| 7,603,791 | B1 | * | 10/2009 | Griffin | 34/77 |
| 7,665,225 | B2 | * | 2/2010 | Goldberg et al. | 34/73 |
| 7,665,227 | B2 | * | 2/2010 | Wright et al. | 34/339 |
| 7,882,647 | B2 | * | 2/2011 | Ikemizu | 34/524 |
| 7,895,770 | B2 | * | 3/2011 | Bae et al. | 34/595 |
| 7,921,578 | B2 | * | 4/2011 | McAllister et al. | 34/597 |
| 7,930,838 | B2 | * | 4/2011 | Bae et al. | 34/597 |

FOREIGN PATENT DOCUMENTS

| | | | | |
|---|---|---|---|---|
| CN | 1464089 | A | | 12/2003 |
| DE | 3618920 | A1 | * | 12/1987 |
| DE | 19547613 | A1 | * | 6/1996 |
| DE | 100 30 531 | A1 | | 1/2002 |
| DE | 600 08 210 | T2 | | 12/2004 |
| DE | 102006009057 | A1 | * | 9/2006 |
| DE | 102007025289 | A1 | * | 12/2008 |
| EP | 0 324 589 | A1 | | 7/1989 |
| EP | 484607 | A1 | * | 5/1992 |
| EP | 552842 | A1 | * | 7/1993 |
| EP | 552843 | A1 | * | 7/1993 |
| EP | 743389 | A1 | * | 11/1996 |
| EP | 1990466 | A1 | * | 11/2008 |
| EP | 2037035 | A1 | * | 3/2009 |
| EP | 2110473 | A2 | * | 10/2009 |
| GB | 2228308 | A | * | 8/1990 |
| JP | 02023993 | A | * | 1/1990 |
| JP | 02046895 | A | * | 2/1990 |
| JP | 02114999 | A | * | 4/1990 |
| JP | 02215500 | A | * | 8/1990 |
| JP | 02305593 | A | * | 12/1990 |
| JP | 03272798 | A | * | 12/1991 |
| JP | 04158895 | A | * | 6/1992 |
| JP | 04292197 | A | * | 10/1992 |
| JP | 05220298 | A | * | 8/1993 |
| JP | 2005027768 | A | * | 2/2005 |
| JP | 2005168940 | A | * | 6/2005 |
| JP | 2008264164 | A | * | 11/2008 |
| KR | 10-2008-0004028 | | | 1/2008 |
| KR | 10-2008-0062618 | | | 7/2008 |
| WO | WO 2010143818 | A2 | * | 12/2010 |

* cited by examiner

CLOTH TREATING APPARATUS

This application claims the benefit of Korean Patent Application No. 10-2007-0078172, filed on Aug. 3, 2007, which is hereby incorporated by reference as if fully set forth herein.

BACKGROUND OF THE INVENTION

1. Field of the Invention

The present invention relates to a cloth treating apparatus, and more particularly, to a cloth treating apparatus, which supplies air to an accommodating space receiving clothes to dry the clothes.

2. Discussion of the Related Art

Generally, cloth treating apparatuses mean apparatuses, which perform washing and/or drying of laundry. Here, a single cloth treating apparatus may perform only a washing or drying function, or both washing and drying functions. Recently, a cloth treating apparatus with a moisture supply device having a refresh function, such as removal of wrinkles, smells, and static electricity of clothes, has been widespread.

Such a cloth treating apparatus includes an accommodating space to receive clothes, an air supply device neighboring with the accommodating space to supply air to the accommodating space, and an electric component chamber, in which a moisture supply device to spray moisture is installed.

The air emitted from the air supply device or the moisture sprayed from the moisture supply device is supplied to the accommodating space, and treats the clothes received in the accommodating space. However, a cabinet of the cloth treating apparatus is mostly made of a metal, the air or the moisture supplied to the accommodating space contacts the inner surface of the cabinet having a relatively low temperature and is condensed, thus generating condensed water in the accommodating space.

When the condensed water generated in the accommodating space is left, as it is, substances harmful to the human body, such as mold, are generated in the accommodating space and cause sanitary problems.

SUMMARY OF THE INVENTION

Accordingly, the present invention is directed to a cloth treating apparatus.

One object of the present invention is to provide a cloth treating apparatus with a condensed water treating device, which treats condensed water generated in a accommodating space receiving clothes when air or moisture is supplied to the accommodating space.

To achieve this object and other advantages and in accordance with the purpose of the invention, as embodied and broadly described herein, a cloth treating apparatus includes a cabinet including a accommodating space to receive clothes, and an electric component chamber, in which a moisture supply device to spray moisture to the accommodating space and a air supply device to supply air are installed; and a condensed water treating unit to treat condensed water, generated by condensing the moisture sprayed to the accommodating space or the air supplied from the air supply device.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
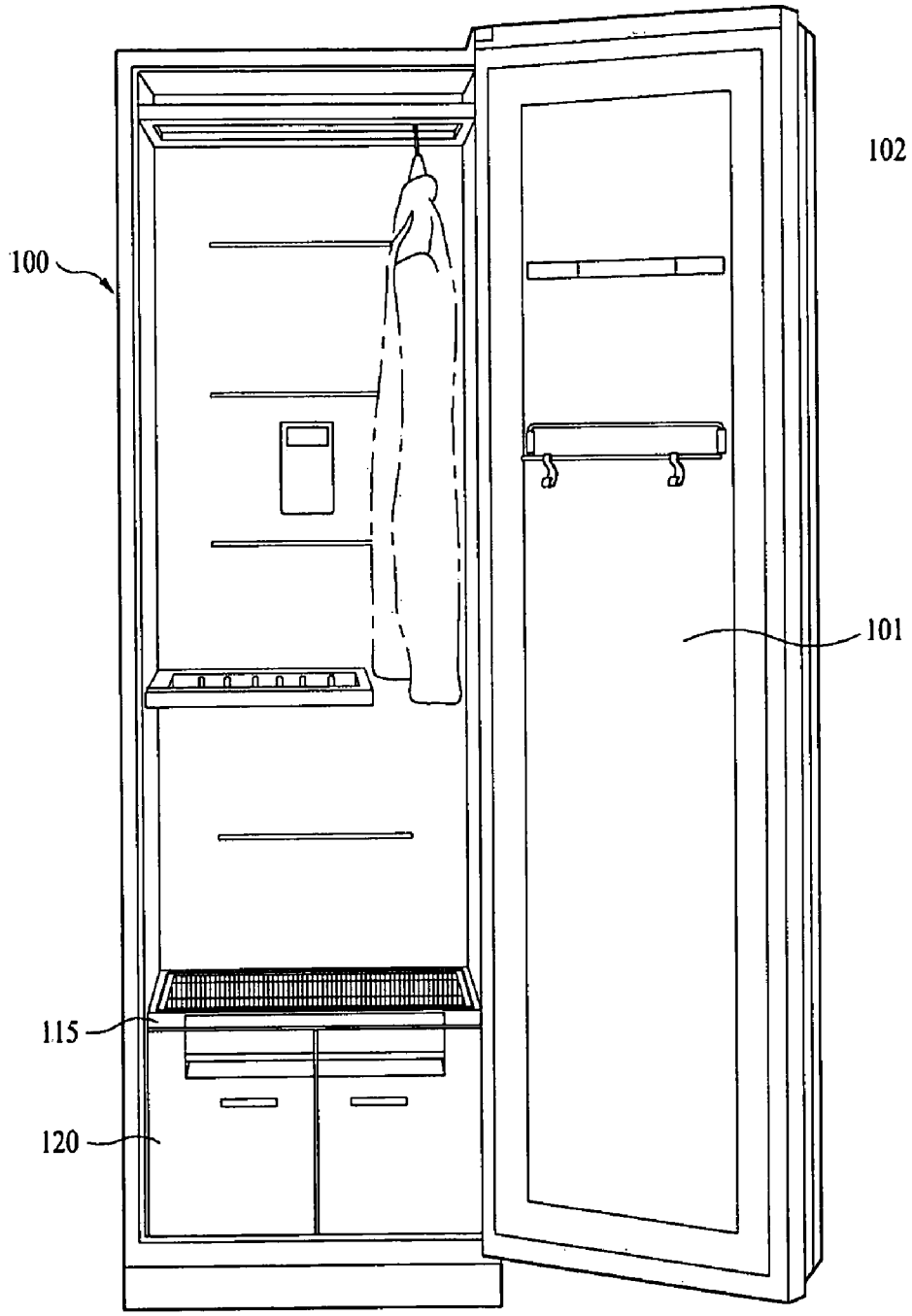
FIG. 1 is a perspective view of a cloth treating apparatus in accordance with one embodiment of the present invention.
Figure 2:
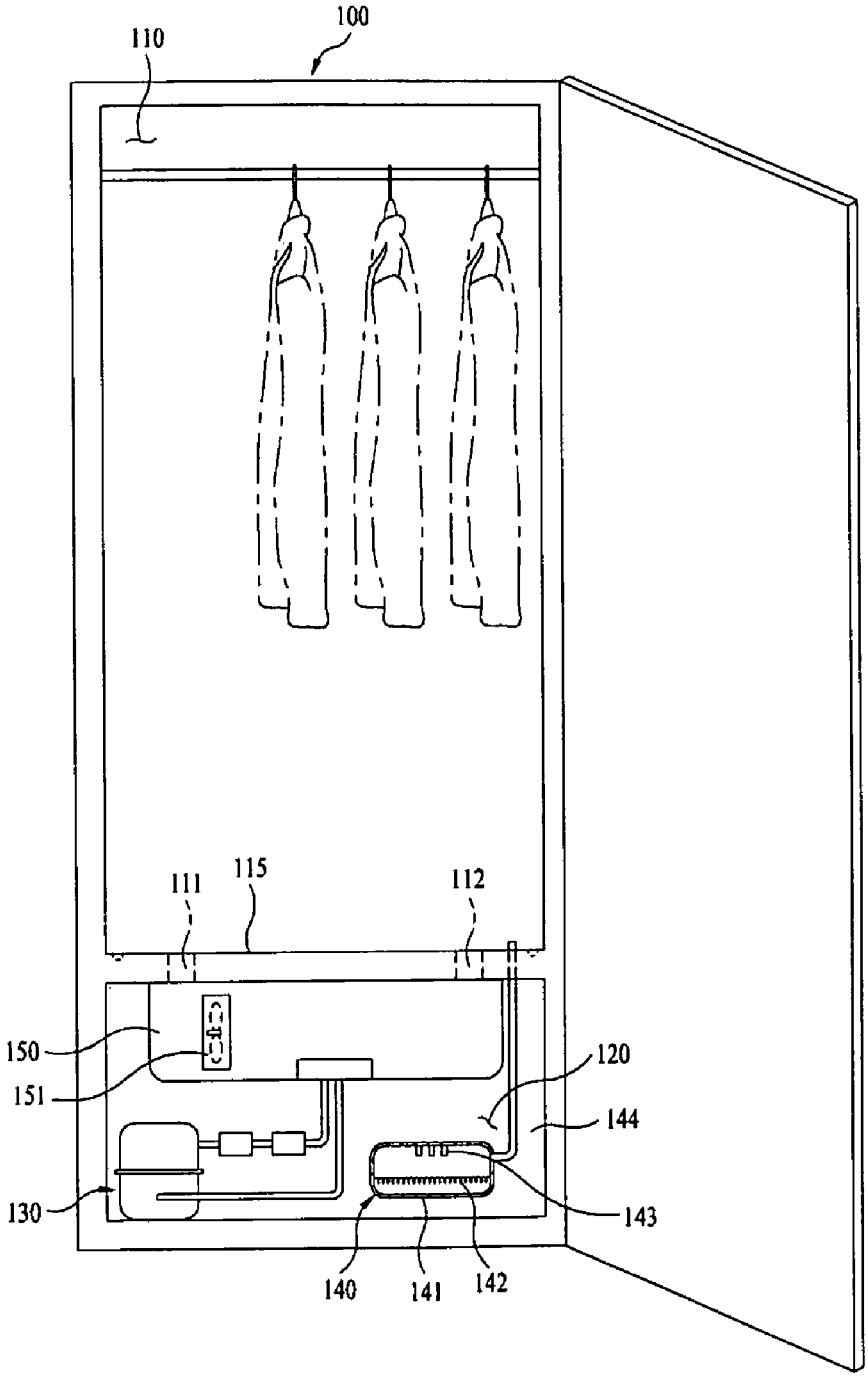
FIG. 2 is a schematic view illustrating the internal constitution of the cloth treating apparatus of FIG. 1.

As shown in FIGS. 1 and 2, a cloth treating apparatus in accordance with one embodiment of the present invention has an external appearance formed by a cabinet 100. The front surface of the cabinet 100 is opened, and the opened front surface of the cabinet 100 is opened and closed by a door 101. A gasket 102 to adhere the door 101 closely to the front surface of the cabinet 100 when the door 101 is closed is installed on the rear surface of the door 101. A magnetic substance, such as a rubber magnet, is installed in the gasket 102, and thus allows the door 101 to be adhered closely to the front surface of the metal-made cabinet 100 when the door 101 is closed.

An accommodating space 110 to receive clothes is formed in the upper portion of the inside of the cabinet 100, and an electric component chamber 120, in which various devices to treat the clothes are installed, is formed in the lower portion of the inside of the cabinet 100. The accommodating space 110 and the electric component chamber 120 are divided from each other by a diaphragm 115.

Further, an air supply device 130 to supply air to the accommodating space 110 and a moisture supply device 140 to supply moisture to the accommodating space 110 are installed in the electric component chamber 120.

Desirably air supplied by the air supply device 130 is hot air, and moisture supplied by the moisture supply device 140 is steam (air will be described 'hot air' and moisture will be described 'steam' as the follow).

Although FIG. 2 illustrates a method, in which the air supply device 130 generates heat using a heat pump forming a refrigeration cycle and supplies the generated heat to the accommodating space 110, various methods, including a method, in which the air supply device 130 generates heat using an electric heater and supplies the generated heat to the accommodating space 110, may be used.

In order to supply the hot air generated by the air supply device 130 to the accommodating space 110, a supply duct 150 is installed in the electric component chamber 120, and an air blast fan 151 is installed in the supply duct 150. An air inlet 111, through which air flows into the accommodating space 110, is formed at one side of the bottom surface of the accommodating space 110, and an air outlet 112, through which the air flows out of the accommodating space 110, is formed at the other side of the bottom surface of the accommodating space 110, such that the hot air supplied from the air supply device 130 can enter the inside of the accommodating space 110 and circulate. Further, the air inlet 111 and the air outlet 112 are respectively connected to both ends of the supply duct 150.

The moisture supply device 140 to generate steam is installed in the electric component chamber 120. Further, a steam supply pipe 144 to connect the moisture supply device 140 and the accommodating space 110 and thus guide the steam generated from the moisture supply device 140 to the accommodating space 110 is provided in the electric component chamber 120.

The moisture supply device 140 includes a case 141 to store water, a heater 142 installed in the case 141, and a water level sensing unit 143 to sense a water level in the case 141. Here, any one method out of a tap water direct connection method, in which the moisture supply device 140 is directly connected to a water supply source such that water is supplied from the water supply source to the moisture supply device 140, and a cartridge method, in which a user puts a designated amount of water into the case 141 of the moisture supply device 140, may be used.

The cloth treating apparatus of the present invention includes a condensed water treating unit, which treats condensed water generated by contact of the hot air supplied from the air supply device 130 or the steam supplied from the moisture supply device 140 with the inner surface of the cabinet 100 forming the accommodating space 110.

The condensed water treating unit includes a water collecting unit 160 to collect the condensed water generated in the accommodating space 110, and a heating unit to heat and evaporate the condensed water generated in the accommodating space 110.

Figure 3:
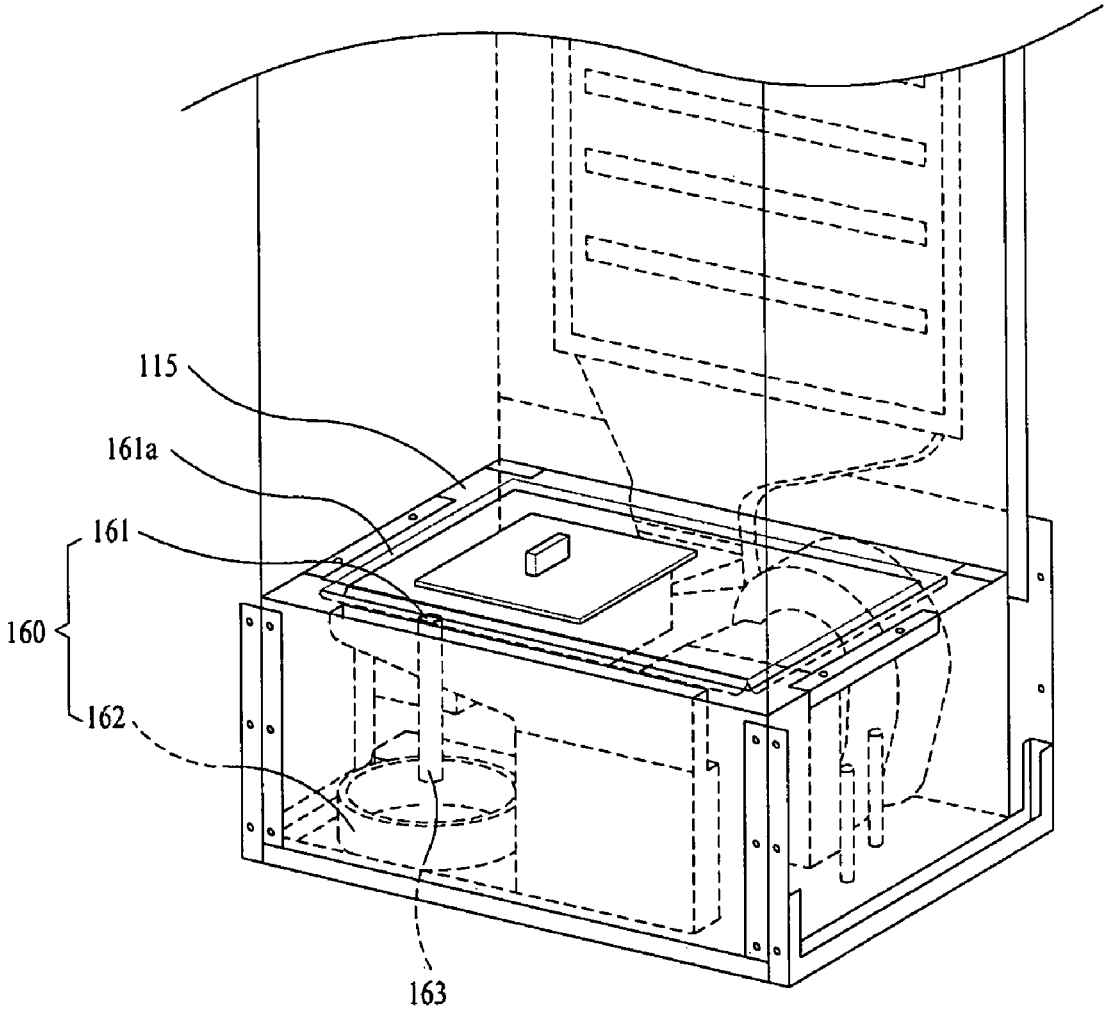
FIG. 3 is a perspective view of a condensed water treating device in accordance with one embodiment of the present invention.

FIG. 3 is a perspective view of the water collecting unit 160 installed in the cloth treating device in accordance with the present invention.

The water collecting unit 160 includes a drain 161 to collect the condensed water generated in the accommodating space 110, and a sump 162 to gather the condensed water collected by the drain 161.

The drain 161 is continuously formed along the edge of the diaphragm 115 forming the bottom surface of the accommodating space 110. Thus, when the condensed water generated by the contact of the hot air or the steam supplied to the accommodating space 110 with the inner surface of the cabinet 100 flows down along the inner surface of the cabinet 100, the condensed water is collected in the drain 161.

In order to gather the condensed water collected in the drain 161, a discharge hole 161*a* is formed at one side of the drain 161, and the sump 162 to gather the condensed water discharged through the discharge hole 161 is installed below the discharge hole 161*a*. Preferably, a guide plate 163, which guides the condensed water to prevent the condensed water discharged through the discharge hole 161*a* from being splashed about, is installed.

The diaphragm 115 is inclined toward the discharge holes 161*a* such that the condensed water collected in the drain 161 can flow to the discharge hole 161*a*. Thus, the condensed water generated in the accommodating space 110 flows down along the inner surface of the cabinet 100 and is firstly collected in the drain 161, and the condensed water collected in the drain 161 flows down through the discharge hole 161*a* and is secondarily collected in the sump 162.

In order to allow a user to empty the sump 162 filled with the condensed water, the sump 162 is detachably installed in the electric component chamber 120. Thus, a user can periodically empty the sump 162 filled with the condensed water.

The above embodiment describes the sump 162 detachably installed in the electric component chamber 120. In this case, the sump 162 is installed in the rear portion of the electric component chamber 120, and thus it may be difficult to separate the sump 162 from the electric component chamber 120. Therefore, a water drain tank (not shown), which is connected to the sump 162 and detachably installed at the front portion of the cabinet 100, is provided such that the water collected in the sump 162 may be transferred to the water drain tank using a pump (not shown).

The cloth treating apparatus in accordance with one embodiment of the present invention includes the water collecting unit 160 including the drain 161 and the sump 162, thus being capable of collecting and treating the condensed water generated in the accommodating space 110.

Although the above embodiment describes the condensed water treating unit, which collects the condensed water, generated in the accommodating space 110, in one place and then causes a user to remove the collected condensed water, a condensed water treating unit, which does not require a user to remove the collected condensed water, will be described hereinafter. Here, some parts in this embodiment, which are substantially the same as those in the former embodiment, are denoted by the same reference numerals even though they are depicted in different drawings, and a detailed description thereof will be omitted.

Figure 4:
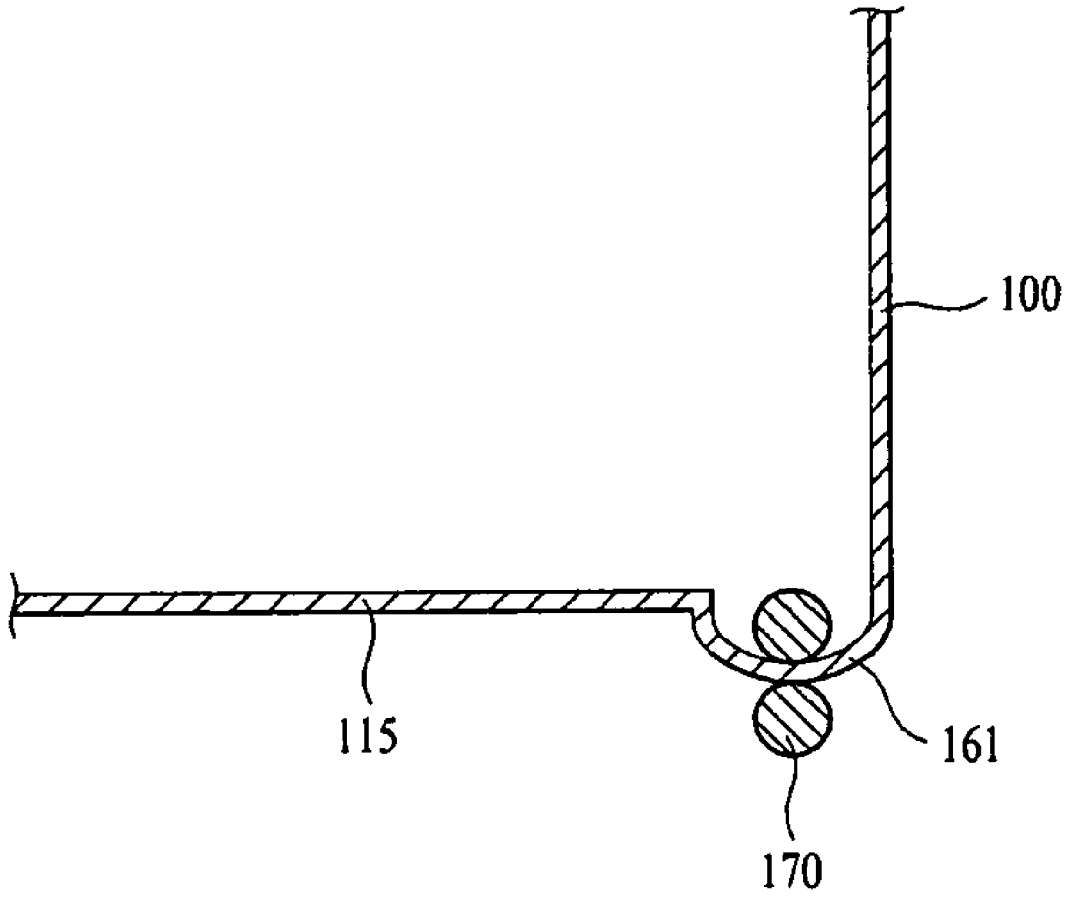
FIG. 4 is a cross-sectional view of a condensed water treating device in accordance with another embodiment of the present invention.

As shown in FIG. 4, a condensed water treating unit in accordance with another embodiment of the present invention includes a water collecting unit 160 including only a drain 161. Further, the drain 161 is not provided with a discharge hole to discharge the collected condensed water. The diaphragm 150, on which the drain 161 is formed, is horizontally installed. However, a heating unit 170, which applies heat to the drain 161 to evaporate the condensed water collected in the drain 161, is installed below the drain 161. A heat wire or a thermoelectric element may be used as the heating unit 170. Since the condensed water collected in the drain 161 is evaporated using the heating unit 170 installed below the drain 161, as described above, it is not necessary to periodically remove the condensed water collected in the drain 161.

Figure 5:
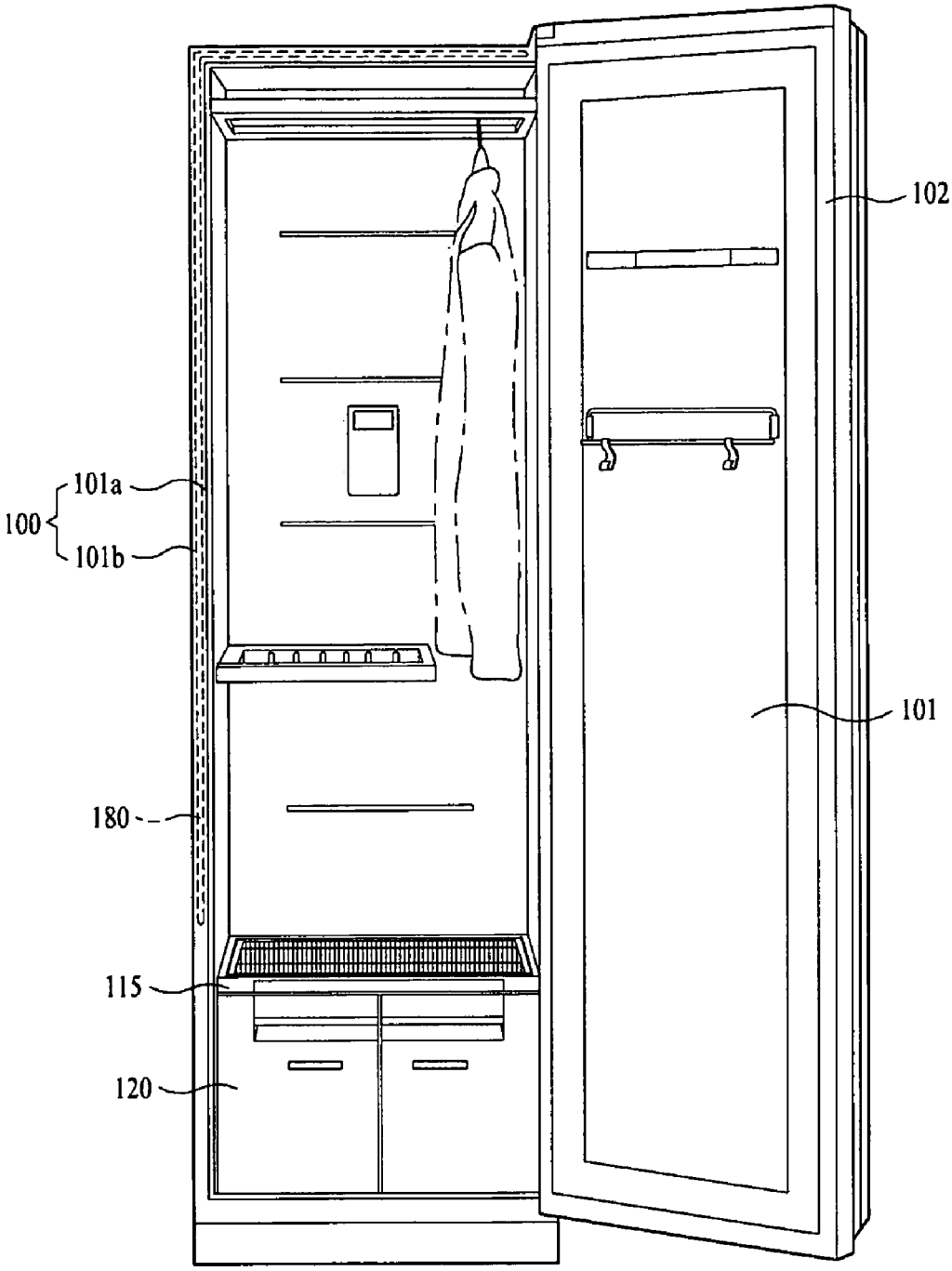
FIG. 5 is a front view of a condensed water treating device in accordance with yet another embodiment of the present invention.

FIG. 5 illustrates a condensed water treating unit in accordance with yet another embodiment of the present invention.

Condensed water can be easily generated on the gasket 102 installed on the door 101 opening and closing the front surface of the cabinet 100. The reason is that the gasket 102 is a boundary between the accommodating space 110 having a high temperature and the outside of the cabinet 100 having a low temperature and thus hot air or steam of the inside of the accommodating space 110 is easily condensed on the gasket 102. When the condensed water generated on the gasket 102 is left for a long time, the gasket 102 may be covered with mold.

Thus, in order to remove condensed water generated on the contact portion between the front surface of the cabinet 100 and the gasket 102 of the door 101, a heating unit 180 is installed, as shown in FIG. 5.

The cabinet 100 includes an internal case 101*a* forming the accommodating space 110, and an external case 101*b* separated from the internal case 101*a* by a designated interval. Preferably, the heating unit 180 is continuously installed between the internal case 101*a* and the external case 101*b*. Although this embodiment describes the heating unit 180 installed on the cabinet 100, the heating unit 180 may be installed on a portion of the door 100, on which the gasket 102 is mounted. Any heat generating element, such as a heat wire or a thermoelectric element, may be used as the heating unit 180.

As described above, the heating unit 180 is installed on the contact portion between the cabinet 100 and the door 101, thus preventing the generation of mold due to the condensed water.

The condensed water treating units in accordance with various embodiments of the present invention have been described. In the above embodiments, the water collecting unit 160, and the heating units 170 and 180 may be individually or simultaneously used.

As apparent from the above description, the present invention provides a cloth treating apparatus with a condensed water treating unit, which treats condensed water generated in a accommodating space receiving clothes to prevent the generation of substances harmful to the human body, such as mold, within the accommodating space.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cloth treating apparatus comprising:

a cabinet including an accommodating space to receive clothes, and an electric component chamber, in which a moisture supply device to spray moisture to the accommodating space and an air supply device to supply hot air to the accommodating space are installed;

a condensed water treating unit to collect condensed water, generated by condensing the moisture sprayed to the accommodating space or the air supplied from the air supply device; and a first heating unit installed to the condensed water treating unit and evaporating the condensed water collected in the condensed water treating unit by heating.

2. The cloth treating apparatus according to claim 1, wherein the condensed water treating unit includes a drain to collect the condensed water generated in the accommodating space.

3. The cloth treating apparatus according to claim 2, wherein the drain is continuously formed along the edge of the bottom surface of the accommodating space.

4. The cloth treating apparatus according to claim 2, wherein the condensed water treating unit further includes a drain hole formed through the drain to discharge the condensed water collected in the drain, and a sump installed below the drain hole to gather the condensed water discharged through the discharge hole.

5. The cloth treating apparatus according to claim 4, wherein the bottom surface of the accommodating space is inclined such that the condensed water collected in the drain flows toward the discharge hole.

6. The cloth treating apparatus according to claim 4, wherein the sump is detachably connected to the cabinet.

7. The cloth treating apparatus according to claim 4, wherein the condensed water treating unit further includes a water drain tank detachably connected to the cabinet and connected to the sump such that a user can remove the condensed water collected in the sump, and a pump to transfer the condensed water collected in the sump to the water drain tank.

8. The cloth treating apparatus according to claim 1, wherein the first heating unit is installed under the condensed water treating unit, or wherein the first heating unit is at respective corners of a bottom surface of the accommodating space.

9. The cloth treating apparatus according to claim 1, further comprising:

a door to open and close the opened front of the accommodating space; and a second heating unit installed at a contact portion between the door and the cabinet and removing condensed water generated on the contact portion by heating.

10. The cloth treating apparatus according to claim 9, wherein the cabinet includes an internal case forming the accommodating space and an external case separated from the internal case, and the heating unit is installed between the internal case and the external case.

* * * * *